US009625867B2

(12) United States Patent
Fukai

(10) Patent No.: US 9,625,867 B2
(45) Date of Patent: Apr. 18, 2017

(54) IMAGE FORMING APPARATUS

(71) Applicant: Konica Minolta, Inc., Tokyo (JP)

(72) Inventor: Shougo Fukai, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/731,875

(22) Filed: Jun. 5, 2015

(65) Prior Publication Data

US 2015/0355591 A1 Dec. 10, 2015

(30) Foreign Application Priority Data

Jun. 10, 2014 (JP) ..... 2014-119649

(51) Int. Cl.
*G03G 15/00* (2006.01)

(52) U.S. Cl.
CPC ..... *G03G 15/6523* (2013.01); *G03G 15/70* (2013.01)

(58) Field of Classification Search
CPC ... G03G 2215/00455; G03G 215/0045; G03G 21/1638; G03G 15/6523; G03G 2215/00814; G03G 2221/1675
See application file for complete search history.

(56) References Cited

U.S. PATENT DOCUMENTS

2008/0112746 A1* 5/2008 Yamamoto ..... G03G 15/70 399/385
2013/0100219 A1* 4/2013 Tokisawa ..... B41J 11/006 347/102

FOREIGN PATENT DOCUMENTS

| | | | |
|---|---|---|---|
| JP | H1020593 | A | 1/1998 |
| JP | 2002087665 | A | 3/2002 |
| JP | 2008119935 | A | 5/2008 |
| JP | 2011177948 | A | 9/2011 |
| JP | 2011224933 | A | 11/2011 |

OTHER PUBLICATIONS

Notice of Reasons for Rejection; Patent Application No. 2014-119649; Dispatch Date: Mar. 8, 2016; Drafting Date: Mar. 4,2016; English translation of Notice of Reasons for Rejection; total of 8 pages.

* cited by examiner

*Primary Examiner* — Matthew G Marini
(74) *Attorney, Agent, or Firm* — Lucas & Mercanti, LLP

(57) ABSTRACT

An image forming apparatus includes: a conveyance section configured to convey a sheet along a sheet feeding path; an image forming section configured to transfer and fix a toner image on a sheet conveyed by the conveyance section to form an image; and a plurality of cutting sections configured to cut a sheet that is conveyed through the sheet feeding path in a sheet width direction.

12 Claims, 6 Drawing Sheets

IMAGE FORMING APPARATUS

CROSS REFERENCE TO RELATED APPLICATIONS

This application is entitled to and claims the benefit of Japanese Patent Application No. 2014-119649, filed on Jun. 10, 2014, the disclosure of which including the specification, drawings and abstract is incorporated herein by reference in its entirety.

BACKGROUND OF THE INVENTION

1. Field of the Invention

The present invention relates to an electrophotographic image forming apparatus.

2. Description of Related Art

In general, an electrophotographic image forming apparatus (such as a printer, a copy machine, and a fax machine) is configured to irradiate (expose) a uniformly-charged photoconductor (for example, a photoconductor drum) with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed. Further, the toner image is directly or indirectly transferred to a sheet through an intermediate transfer belt, followed by heating and pressurization for fixing, whereby an image is formed on the sheet.

When a jam is caused in the above-described image forming apparatus, sheet advancing is manually performed to pull out the sheet from the apparatus, thereby eliminating the jam. In addition, in an image forming apparatus in which a conveyance section that inverts a sheet for duplex printing is provided as a sheet conveyance unit (so-called Auto-Duplex Unit (ADU)), when a jam is caused in the sheet conveyance unit, the user can pull out the sheet conveyance unit from the image forming apparatus to remove the sheet remaining in the sheet feeding path. Various members (for example, a guide member) provided on the sheet feeding path can be exposed by pulling out the sheet conveyance unit from the image forming apparatus, and thus a sheet can be carefully removed from an suitable place so as not to scatter unfixed toner.

In addition, a technique for unjamming has been proposed in which a sheet is cut and divided into a part on which a toner image is transferred and a part on which no toner image is transferred, and the former part is removed from the sheet ejecting side whereas the latter part is removed from the sheet feeding side, thereby preventing unfixed toner from being attached on a registration roller (for example, Japanese Patent Application Laid-Open No. 10-20593).

A jam which is caused during image formation on flat sheets can be relatively readily eliminated in the above-described way. However, to eliminate a jam which is caused during an image formation on a long sheet such as a roll sheet and a continuous sheet, the long sheet has to be cut with a cutter or the like on the outside of the apparatus and has to be pulled out from the apparatus by performing sheet advancing, which is a complicated and unsafe task. In addition, when an end portion of a cut long sheet falls to the floor, dust adheres to the long sheet, and consequently the interior parts of the apparatus may possibly be contaminated or damaged when the long sheet is again conveyed. Furthermore, since the long sheet has to be externally fed to the image forming apparatus for conveyance, sheet conveyance takes time.

In addition, a long sheet is typically exists over the entire length of the sheet feeding path (the state where the sheet protrudes from the sheet conveyance unit to the sheet feeding side or the sheet ejecting side), and when the sheet conveyance unit is pulled out at the time of unjamming, the sheet may be torn and broken, and paper debris may remain in the apparatus. Such paper debris remaining in the apparatus may damage components of the apparatus.

The term "long sheet" as used herein means a sheet having a sheet length greater than that of flat sheets (for example, A3-sheets) which can be contained in a commonly used sheet-feed tray section provided in an image forming apparatus, and the term "long sheet" includes, for example, roll sheets, continuous sheets, flat sheets for banner or hanging banner, and the like.

SUMMARY OF THE INVENTION

An object of the present invention is to provide an image forming apparatus which can readily eliminate problems such as a jam caused in the apparatus.

To achieve at least one of the abovementioned objects, an image forming apparatus reflecting one aspect of the present invention includes: a conveyance section configured to convey a sheet along a sheet feeding path; an image forming section configured to transfer and fix a toner image on a sheet conveyed by the conveyance section to form an image; and a plurality of cutting sections configured to cut a sheet that is conveyed through the sheet feeding path in a sheet width direction.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, an embodiment of the present invention will be described in detail with reference to the accompanying drawings.

Figure 1:
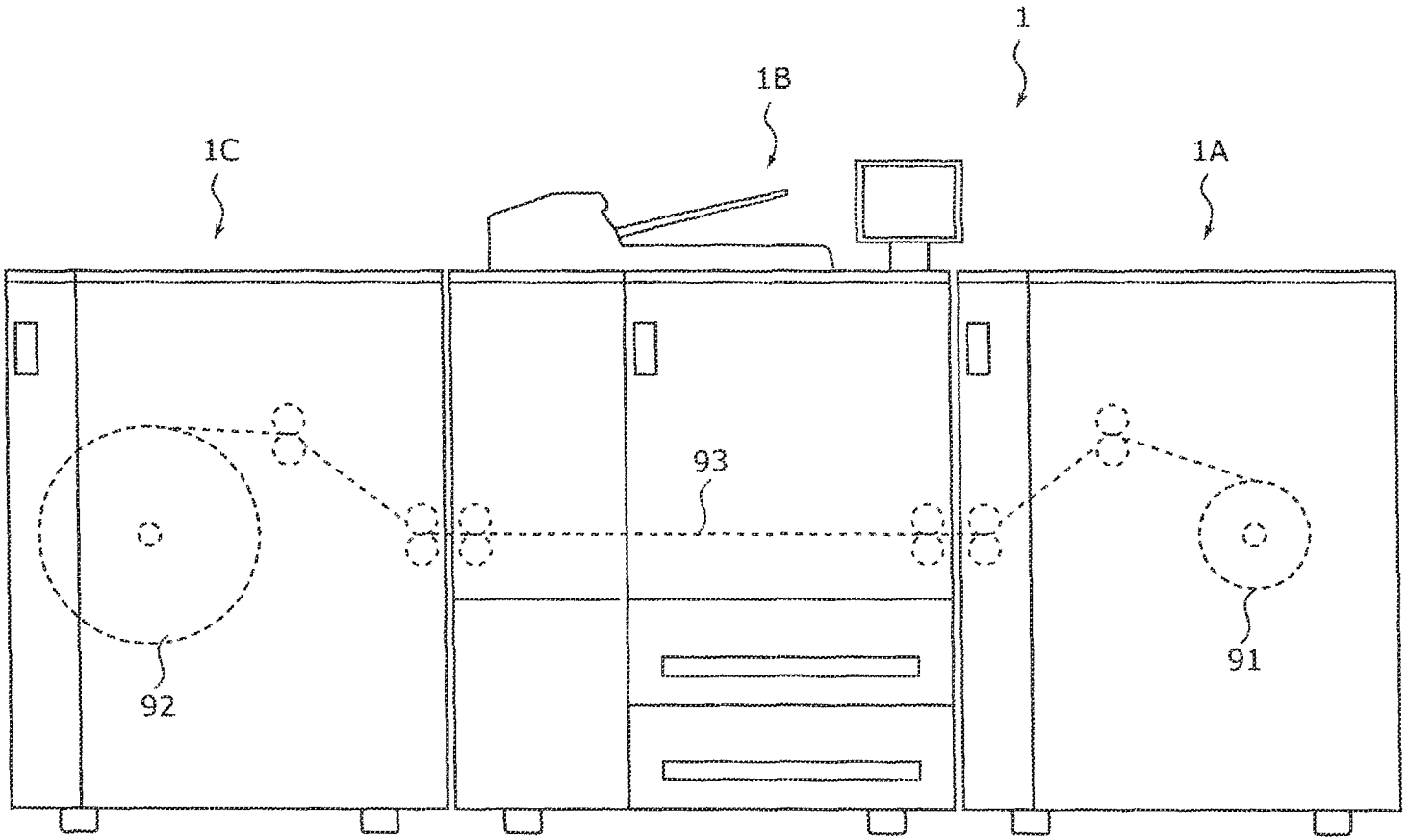
FIG. 1 illustrates an image forming apparatus according to an embodiment of the present invention.

FIG. 1 illustrates a configuration of image forming apparatus 1 according to the embodiment of the present invention.

Image forming apparatus 1 illustrated in FIG. 1 includes sheet feeding apparatus 1A, image forming apparatus main body 1B, and winding apparatus 1C. While image forming apparatus 1 is intended for an image formation on a roll sheet, the present invention is suitable for an image forming apparatus for performing an image formation on long sheets such as a roll sheet, a continuous sheet, flat sheets for banners, hanging banners and the like.

Sheet feeding apparatus 1A includes roll sheet feeding section 91, and feeds sheets under the instruction of image forming apparatus main body 1B for example. The roll sheet fed from sheet feeding apparatus 1A is conveyed along sheet feeding path 93. Image forming apparatus main body 1B forms an image on a roll sheet fed from sheet feeding apparatus 1A. While image forming apparatus main body 1B is intended to form an image on a roll sheet fed from sheet feeding apparatus 1A, image forming apparatus main body 1B can also independently form images on flat sheets. Winding apparatus 1C includes roll winding section 92, and winds up a roll sheet on which an image has been formed by image forming apparatus main body 1B.

Figure 2:
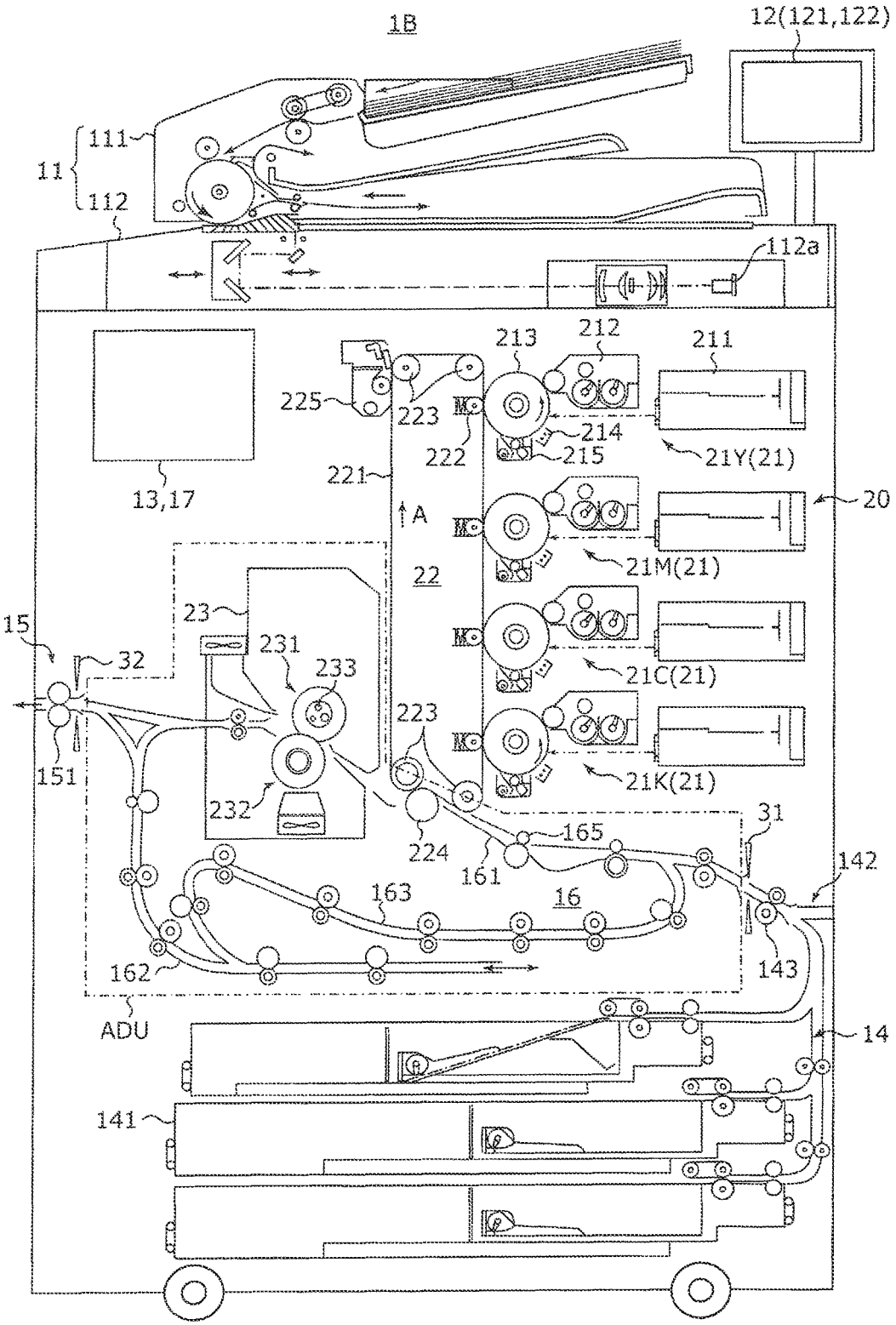
FIG. 2 illustrates a general configuration of a main body of the image forming apparatus according to the embodiment of the present invention.
Figure 3:
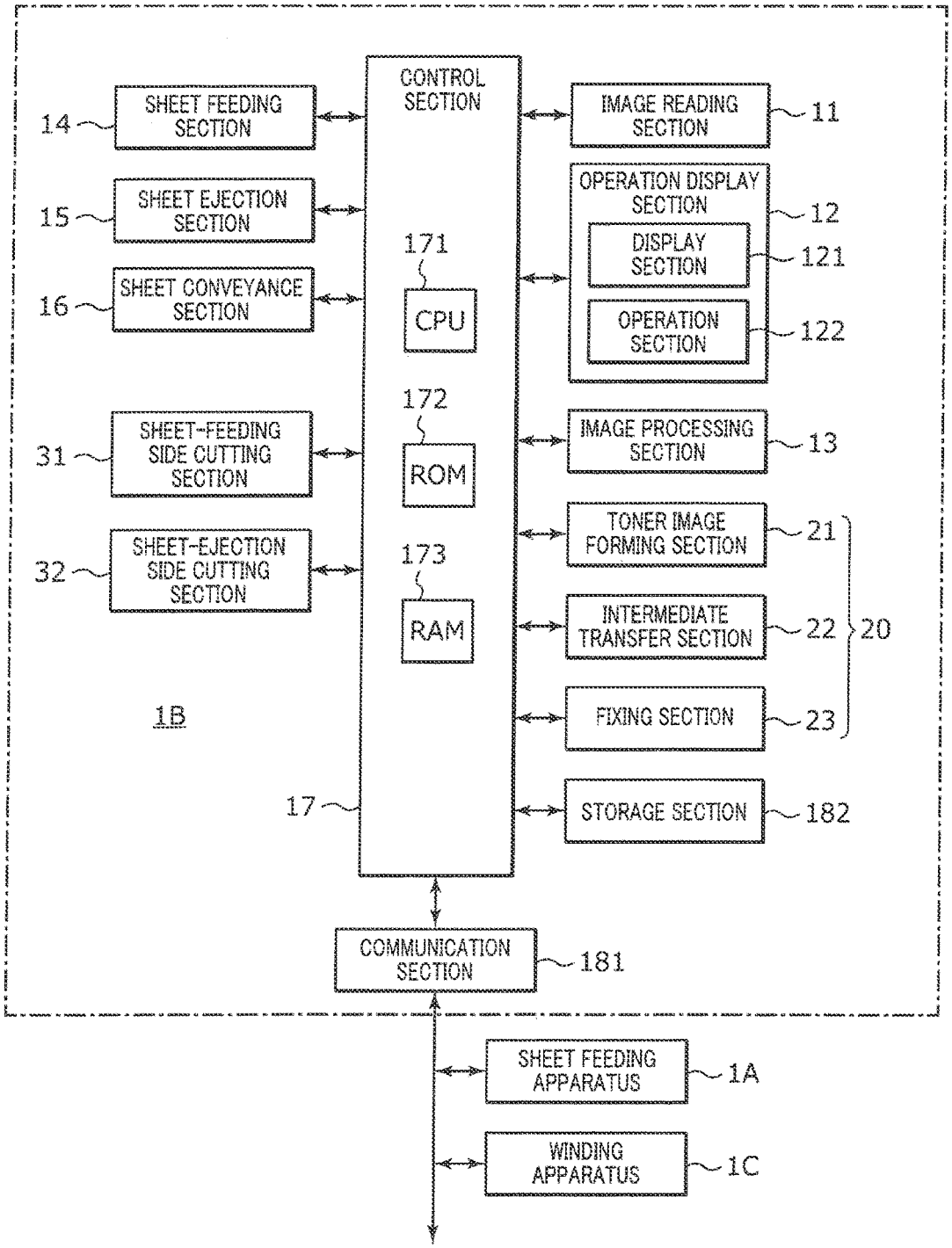
FIG. 3 illustrates a principal part of a control system of the main body of the image forming apparatus according to the present embodiment.

FIG. 2 illustrates a general configuration of image forming apparatus main body 1B. FIG. 3 illustrates a principal part of a control system of image forming apparatus main body 1B.

Image forming apparatus main body 1B illustrated in FIGS. 2 and 3 is a color image forming apparatus of an intermediate transfer system using electrophotographic process technology. A longitudinal tandem system is adopted for image forming apparatus main body 1B. In the longitudinal tandem system, respective photoconductor drums 213 corresponding to the four colors of YMCK are placed in series in the travelling direction (vertical direction) of intermediate transfer belt 221, and the toner images of the four colors are sequentially transferred to intermediate transfer belt 221 in one cycle.

That is, image forming apparatus main body 1B transfers (primary-transfers) toner images of yellow (Y), magenta (M), cyan (C), and black (K) formed on photoconductor drums 213 to intermediate transfer belt 221, and superimposes the toner images of the four colors on one another on intermediate transfer belt 221. Then, image forming apparatus main body 1B transfers (secondary-transfers) the resultant image to a sheet, to thereby form an image.

As illustrated in FIGS. 2 and 3, image forming apparatus main body 1B includes image reading section 11, operation display section 12, image processing section 13, image forming section 20, sheet feeding section 14, sheet ejection section 15, sheet conveyance section 16, and control section 17.

Control section 17 includes central processing unit (CPU) 171, read only memory (ROM) 172, random access memory (RAM) 173 and the like. CPU 171 reads a program suited to the processing out of ROM 172 or storage section 182, develops the program in RAM 173, and integrally controls the operation of each block of image forming apparatus 1B, sheet feeding apparatus 1A and winding apparatus 1C in cooperation with the developed program.

Communication section 181 has various interfaces such as network interface card (NIC), modulator-demodulator (MODEM), and universal serial bus (USB), for example. Storage section 182 is composed of, for example, a non-volatile semiconductor memory (so-called flash memory) or a hard disk drive.

Storage section 182 stores therein a look-up table which is referenced when the operation of each block is controlled, for example.

Control section 17 transmits and receives various data to and from an external apparatus (for example, a personal computer) connected to a communication network such as a local area network (LAN) or a wide area network (WAN), through communication section 181. Control section 17 receives image data (input image data) of page description language (PDL) that has been sent from an external device, and controls the apparatus to form an image on a sheet on the basis of the data, for example.

Image reading section 11 includes an automatic document feeder 111 called auto document feeder (ADF), document image scanner (scanner) 112, and the like.

Auto document feeder 111 causes a conveyance mechanism to feed documents placed on a document tray, and sends out the documents to document image scanner 112. Auto document feeder 111 enables images (even both sides thereof) of a large number of documents placed on the document tray to be successively read at once.

Document image scanner 112 optically scans a document fed from auto document feeder 111 to its contact glass or a document placed on its contact glass, and images light reflected from the document on the light receiving surface of charge coupled device (CCD) sensor 112*a*, to thereby read the document image. Image reading section 11 generates input image data on the basis of a reading result provided by document image scanner 112. Image processing section 13 performs predetermined image processing on the input image data.

Operation display section 12 includes, for example, a liquid crystal display (LCD) with a touch panel, and functions as display section 121 and operation section 122. Display section 121 displays various operation screens, image conditions, operating statuses of functions, and the like in accordance with display control signals received from control section 17. Operation section 122 includes various operation keys such as numeric keys and a start key, receives various input operations performed by a user, and outputs operation signals to control section 17.

By operating operation display section 12, the user can perform setting relating to the image formation such as document setting, image quality setting, multiplying factor setting, application setting, output setting, single-sided/duplex printing setting, and sheet setting. In addition, when a jam is caused, an unjamming procedure is displayed on operation display section 12.

Image processing section 13 includes a circuit that performs a digital image process suited to initial settings or user settings on the input image data, and the like. For example, image processing section 13 performs tone correction on the basis of tone correction data under the control of control section 17. Image processing section 13 also performs various correction processes such as color correction and shading correction on the input image data. Image forming section 20 is controlled on the basis of the image data that has been subjected to these processes.

Image forming section 20 includes toner image forming section 21, intermediate transfer section 22, fixing section 23 and the like. Toner image forming section 21 forms toner images of colored toners of a Y component, an M component, a C component, and a K component on the basis of the input image data. Intermediate transfer section 22 transfers a toner image formed by toner image forming section 21 to a sheet. Fixing section 23 fixes a toner image transferred to a sheet.

Toner image forming section 21 includes four toner image forming sections 21Y, 21M, 21C, and 21K for the Y component, the M component, the C component, and the K component, respectively. Since toner image forming sections 21Y, 21M, 21C, and 21K have similar configurations, common elements are denoted by the same reference signs for ease of illustration and description. Only when elements need to be discriminated from one another, Y, M, C, K is added to their reference signs. In FIG. 2, reference signs are given to only the elements of toner image forming section 21Y for the Y component, and reference signs for the elements of other toner image forming sections 41M, 21C, and 21K are omitted.

Toner image forming section 21 includes exposing device 211, developing device 212, photoconductor drum 213, charging device 214, drum cleaning device 215 and the like.

Photoconductor drum 213 is, for example, a negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) made of aluminum. The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 211.

The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Charging device 214 is composed of a corona discharging generator such as a scorotron charging device and a corotron charging device, for example. Charging device 214 evenly negatively charges the surface of photoconductor drum 213 by corona discharge.

Exposing device 211 is composed of, for example, an LED print head including an LED array having a plurality of linearly laid out light-emitting diodes (LED), an LPH driving section (driver IC) for driving each LED, and an lens array that brings light radiated from the LED array into an image on photoconductor drum 213, and the like. Each of the LEDs of LED array 1 corresponds to one dot of an image. Control section 17 controls the LPH driving section to cause a predetermined driving current to flow through the LED array, and thus designated LEDs emit light.

Exposure device 211 irradiates photoconductor drum 213 with light corresponding to the image of each color component. The positive charge generated in the charge generation layer of photoconductor drum 213 irradiated with light is transported to the surface of the charge transport layer, whereby the surface charge (negative charge) of photoconductor drum 213 is neutralized. Thus, an electrostatic latent image of each color component is formed on the surface of photoconductor drum 213 by the potential difference from its surroundings.

Developing device 212 stores developers of respective color components (for example, a two-component developer composed of toner and magnetic carrier). Developing device 212 attaches toner of respective color components to the surfaces of photoconductor drums 213, and visualizes the electrostatic latent image to form a toner image. To be more specific, a developing bias voltage is applied to a developer bearing member (developing roller), and an electric field is formed between photoconductor drum 213 and developer bearing member. By the potential difference between photoconductor drum 213 and the developer bearing member, the charging toner on the developer bearing member is caused to move and attach to a light exposure section on the surface of photoconductor drum 213.

Drum cleaning apparatus 215 includes a drum cleaning blade configured to be brought into sliding contact with the surface of photoconductor drum 213 and the like, and removes residual toner that remains on the surface of photoconductor drum 213 after the primary transfer.

Intermediate transfer section 22 includes intermediate transfer belt 221, primary transfer roller 222, a plurality of support rollers 223, secondary transfer roller 224, belt cleaning device 225 and the like.

Intermediate transfer belt 221 is composed of an endless belt, and is stretched around the plurality of support rollers 223 in a loop form. At least one of the plurality of support rollers 223 is composed of a driving roller, and the others are each composed of a driven roller. When driving roller rotates, intermediate transfer belt 221 travels in arrow A direction at a constant speed.

Primary transfer rollers 222 are disposed on the inner periphery side of intermediate transfer belt 221 in such a manner as to face photoconductor drums 213 of respective color components. Primary transfer rollers 222 are brought into pressure contact with photoconductor drums 213 with intermediate transfer belt 221 therebetween, whereby a primary transfer nip (hereinafter referred to as "primary transfer section") for transferring a toner image from photoconductor drums 213 to intermediate transfer belt 221 is formed.

Secondary transfer roller 224 is disposed on the outer periphery side of intermediate transfer belt 221 in such a manner as to face one of support rollers 223. Support roller 223 that is so disposed as to face intermediate transfer belt 221 is called "backup roller."

Secondary transfer roller 224 is brought into pressure contact with the backup roller with intermediate transfer belt 221 therebetween, whereby a secondary transfer nip (hereinafter referred to as "secondary transfer section") for transferring a toner image from intermediate transfer belt 221 to a sheet is formed.

In the primary transfer section, the toner images on photoconductor drums 213 are sequentially primary-transferred to intermediate transfer belt 221. To be more specific, a primary transfer bias is applied to primary transfer rollers 222, and electric charge of the polarity opposite to the polarity of the toner is applied to the rear side (the side that makes contact with primary transfer rollers 222) of intermediate transfer belt 221, whereby the toner image is electrostatically transferred to intermediate transfer belt 221.

Thereafter, when the sheet passes through the secondary transfer section, the toner image on intermediate transfer belt 221 is secondary-transferred to the sheet. To be more specific, a secondary transfer bias is applied to secondary transfer roller 224, and an electric charge opposite to that of the toner is applied to the rear side (the side that makes contact with secondary transfer roller 224) of the sheet, whereby the toner image is electrostatically transferred to the sheet. The sheet on which the toner image has been transferred is conveyed toward fixing section 23.

Belt cleaning device 225 includes a belt cleaning blade configured to make sliding contact with the surface of intermediate transfer belt 221, and the like, and removes transfer residual toner remaining on the surface of intermediate transfer belt 221 after the secondary transfer.

Alternatively, in intermediate transfer section 22, it is also possible to adopt a configuration (so-called belt-type secondary transfer unit) in which a secondary transfer belt is installed in a stretched state in a loop form around a plurality of support rollers including a secondary transfer roller in place of secondary transfer roller 224.

Fixing section 23 includes upper fixing section 231 having a fixing side member disposed on a fixing surface (the surface on which a toner image is formed) side of a sheet, lower fixing section 232 having a back side supporting member disposed on the rear surface (the surface opposite to the fixing surface) side of a sheet, heating source 233 configured to heat the fixing side member, a pressure contact separation section (not illustrated) configured to bring the back side supporting member into pressure contact with the fixing side member, and the like.

For example, when upper fixing section 231 is of a roller heating type, the fixing roller serves as the fixing side member, and when upper fixing section 231 is of a belt heating type, the fixing belt serves as the fixing side member. In addition, for example, when lower fixing section 232 is of a roller pressing type, the pressure roller serves as the back side supporting member, and when lower fixing section 232 is of a belt pressing type, the pressing belt serves as the back side supporting member. FIG. 2 illustrates a configuration in which upper fixing section 231 is of a roller heating type, and lower fixing section 232 is of a roller pressing type.

Upper fixing section 231 includes an upper fixing section-driving section (not illustrated) for rotating the fixing side member. When control section 17 controls the operation of the upper fixing section-driving section, the fixing side member rotates (travels) at a predetermined speed. Lower fixing section 232 includes a lower fixing section-driving section (not illustrated) for rotating the back side supporting member. When control section 17 controls the operation of the lower fixing section-driving section, the back side supporting member rotates (travels) at a predetermined speed. It is to be noted that, in the case where the fixing side member follows the rotation of the back side supporting member, the upper fixing section-driving section is not required.

Heating source 233 is disposed inside or near the fixing side member. When control section 17 controls the output of heating source 233, the fixing side member is heated, and maintained at a predetermined temperature (for example, a fixable temperature, or a fixation idling temperature). On the basis of the detection result of a fixing temperature detection section (not illustrated) disposed at a position near the fixing side member, control section 17 controls the output of heating source 233.

A pressure contact separation section (not illustrated) presses the back side supporting member against the fixing side member. The pressure contact separation section makes contact with both ends of a shaft that supports the back side supporting member to separately press each end. With this structure, the balance of the nip pressure in the direction along the shaft in the fixing nip can be adjusted. Control section 17 controls the operation of the pressure contact separation section (not illustrated) and the back side supporting member is brought into pressure contact with the fixing side member, whereby a fixing nip for conveying a sheet in a tightly sandwiching manner is formed.

Heat and pressure are applied to a sheet on which a toner image has been secondary-transferred and which has been conveyed along a sheet feeding path at the time when the sheet passes through fixing section 23. Thus, the toner image is fixed to the sheet.

It is to be noted that fixing section 23 may include an air blowing section configured to apply air to the fixing side member or the back side supporting member in order to cool down the fixing side member or the back side supporting member, and in order to separate a sheet from the fixing side member or the back side supporting member.

Sheet feeding section 14 includes sheet-feed tray section 141 and manual sheet feeding section 142. Flat sheets (standard type sheets and special type sheets) discriminated on the basis of their basis weight, size and the like are stored on a predetermined type basis in sheet-feed tray section 141. A roll sheet output from sheet feeding apparatus 1A is fed through manual sheet feeding section 142. In addition, sheet feeding section 14 includes sheet feeding roller section 143 and the like, and feeds a sheet fed from sheet-feed tray section 141 or manual sheet feeding section 142 to sheet conveyance section 16.

Sheet ejection section 15 includes sheet ejection roller section 151 and the like, and ejects a sheet output by sheet conveyance section 16 out of the apparatus.

Sheet conveyance section 16 includes main conveyance section 161, switch-back conveyance section 162, rear surface printing conveyance section 163, a sheet feeding path-switching section (not illustrated) and the like. For example, a part of sheet conveyance section 16 is incorporated in a unit together with fixing section 23, and is detachably mounted to image forming apparatus main body 1B (sheet conveyance unit ADU).

Main conveyance section 161 includes a plurality of conveyance roller sections serving as sheet-conveyance elements for conveying sheets in a sandwiching manner. The conveyance roller sections include entry roller section 165 disposed on the upstream side of the secondary transfer section in the sheet conveyance direction. Main conveyance section 161 conveys flat sheets fed from sheet-feed tray section 141 or a roll sheet fed from sheet feeding apparatus 1A via manual sheet feeding section 142 to convey the sheet through image forming section 20 (secondary transfer section, fixing section 23), and conveys a sheet output from image forming section 20 (fixing section 23) toward sheet ejection section 15.

Switch-back conveyance section 162 temporarily stops a sheet output from fixing section 23, reverses the sheet in the conveyance direction, and conveys the sheet to sheet ejection section 15 or rear surface printing conveyance section 163.

Rear surface printing conveyance section 163 is a circulation path for conveying a sheet switchbacked at switch-back conveyance section 162 to main conveyance section 161. A sheet passes through main conveyance section 161 in a state where the second surface (rear surface) of the sheet faces upward.

A feeding-path-switching section (not illustrated) switches the sheet feeding paths according to whether a sheet output from fixing section 23 is ejected as it is, or is inverted before being ejected, or, is conveyed to rear surface printing conveyance section 163. To be more specific, control section 17 controls the operation of the feeding-path-switching section on the basis of the processing detail of the image formation process (one-sided/duplex printing, face-up sheet ejection, face-down sheet ejection, and the like).

When an image is formed on a roll sheet, a roll sheet is fed from sheet feeding apparatus 1A through manual sheet feeding section 142. The roll sheet thus fed is conveyed to image forming section 20 by main conveyance section 161. Thereafter, a toner image on intermediate transfer belt 221 is secondary-transferred to a surface of the roll sheet at one time at the time when the roll sheet passes through the secondary transfer section, and then a fixing process is performed in fixing section 23. The roll sheet on which an image has been formed is ejected out of the apparatus from sheet ejection section 15, and wound by roll winding section 92 of winding apparatus 1C.

As described, main conveyance section 161 serves as a part of sheet feeding path 93 in the case where an image is formed on a roll sheet in image forming apparatus 1. It is to be noted that, in the case where an image is formed on a roll sheet, switch-back conveyance section 162 and rear surface printing conveyance section 163 are not used.

In main conveyance section 161, a plurality of sheet cutting sections for cutting a sheet are disposed. In FIG. 2, sheet-feeding side cutting section 31 is disposed between sheet feeding roller section 143 and sheet conveyance unit ADU (hereinafter referred to as "sheet-feeding side boundary"), and sheet-ejection side cutting section 32 is disposed between sheet ejection roller section 151 and sheet conveyance unit ADU (hereinafter referred to as "sheet-feeding side boundary"). It is to be noted that sheet-feeding side cutting section 31 may be disposed at the sheet-feeding side boundary in sheet conveyance unit ADU, and sheet-ejection side cutting section 32 may be disposed at the sheet-ejection side boundary in sheet conveyance unit ADU.

Sheet-feeding side cutting section 31 and sheet-ejection side cutting section 32 are, for example, each a cutting section of a slide type or a guillotine type. Control section 17 controls the operation of a cutter driving section (not illustrated), and thus a cutting member (not illustrated) cuts a sheet in the sheet-width direction. When a problem such as a jam is caused, sheet-feeding side cutting section 31 and sheet-ejection side cutting section 32 automatically cut the sheet as necessary.

As described, image forming apparatus 1 includes: a conveyance section (main conveyance section 161, sheet feeding section 14, and sheet ejection section 15) that conveys a sheet along the sheet feeding path; image forming section (20) that transfers and fixes a toner image on a sheet conveyed by the conveyance section to form an image; and a plurality of cutting sections (sheet-feeding side cutting section 31, and sheet-ejection side cutting section 32) that cut a sheet being conveyed through the sheet feeding path in the sheet width direction.

With image forming apparatus 1, a sheet can be cut at two positions in the apparatus, and thus it is possible to cut and remove only a part of the sheet where a problem such as a jam is caused. Therefore, a problem such as a jam caused in the apparatus can be readily eliminated. In particular, image forming apparatus 1 is suitable for the case where an image is formed on a roll sheet or a continuous sheet.

In addition, in image forming apparatus 1, the conveyance section (main conveyance section 161, sheet feeding section 14, and sheet ejection section 15) includes a sheet conveyance unit (ADU) detachably mounted in the main body part of the image forming apparatus 1, and the cutting sections (sheet-feeding side cutting section 31 and sheet-ejection side cutting section 32) are each disposed at a position near the boundary between sheet conveyance unit (ADU) and the main body part. With this configuration, sheet conveyance unit ADU can be pulled out without causing breaking.

Figure 4:
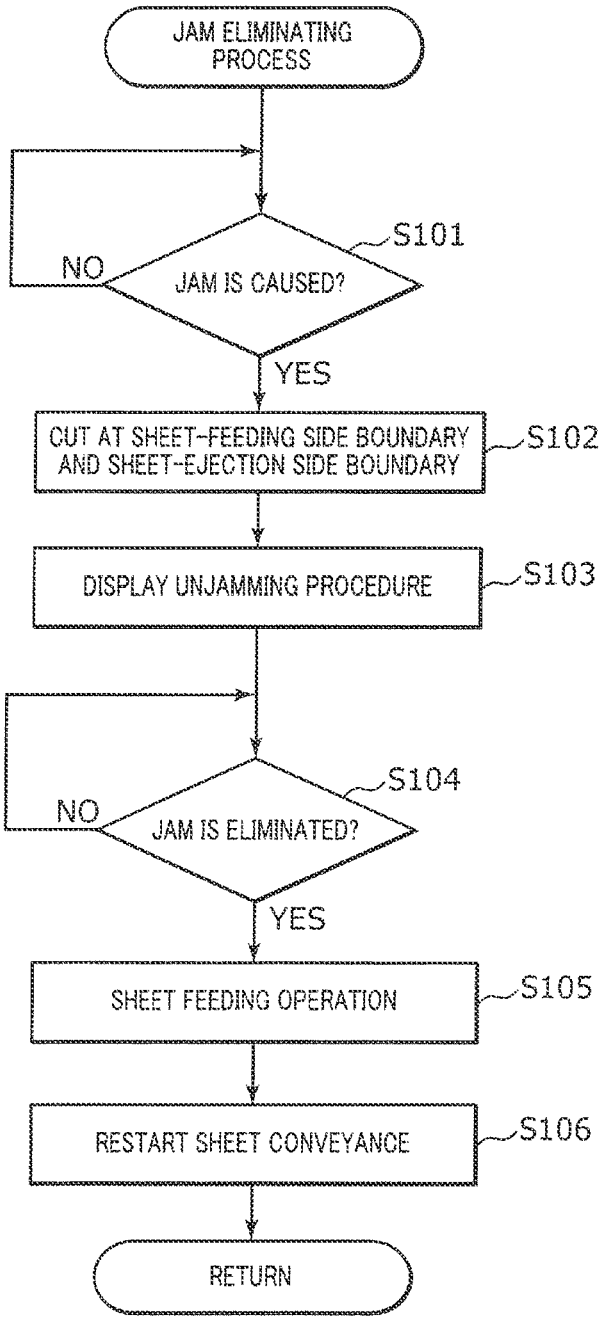
FIG. 4 is a flowchart of an exemplary jam eliminating process in the case where an image is formed on a roll sheet.

FIG. 4 is a flowchart illustrating an exemplary jam eliminating process in the case where an image is formed on a roll sheet. This process is achieved when CPU 171 executes a predetermined program stored in ROM 172 upon the start of an image formation process in image forming apparatus 1 for example.

Figure 5A:
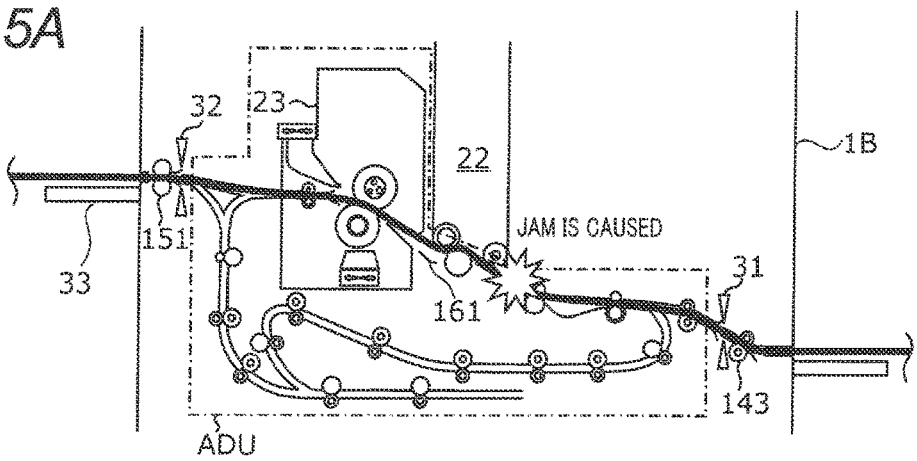
FIG. 5A, FIG. 5B, and FIG. 5C illustrate detailed steps in the jam eliminating process.

At step S101 of FIG. 4, control section 17 determines whether a jam has been caused. For example, since the conveyance roller section disposed in main conveyance section 161 stops when an abnormal torque is generated, control section 17 detects occurrence of a jam on the basis of the stoppage (see FIG. 5A). When a jam has been caused (at step S101 "YES"), the process is advanced to step S102. When no jam has been caused (at step S101 "NO"), the process of step S101 is repeated, and the jam eliminating process is terminated when a series of image formation processes are terminated.

At step S102, control section 17 controls the operations of sheet-feeding side cutting section 31 and sheet-ejection side cutting section 32 to cut the sheet at positions near the sheet-feeding side boundary and the sheet-ejection side boundary across which the roll sheet exists. When an image is formed on a roll sheet, the roll sheet always exists across the sheet-feeding side boundary and the sheet-ejection side boundary, and therefore the roll sheet is cut at these portions.

Figure 5B:
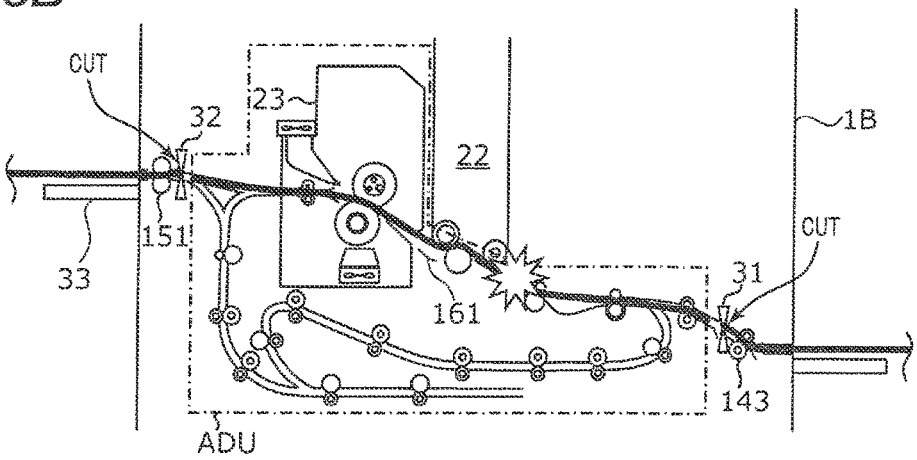

Specifically, image forming apparatus 1 includes a jam detection section (control section 17) that detects occurrence of a jam in the sheet feeding path, and a plurality of cutting sections (sheet-feeding side cutting section 31 and sheet-ejection side cutting section 32) partially cut and remove the sheet such that a part of the sheet where the jam is caused is cut and removed when occurrence of a jam is detected by jam detection section (17) (see FIG. 5B).

With this configuration, a jam caused in the apparatus can be readily eliminated. In addition, since the unsafe task of cutting a sheet with use of a cutter or the like is unnecessary, the safety of the jam eliminating process is enhanced.

A part of the roll sheet thus cut in sheet conveyance unit ADU (hereinafter referred to as "roll sheet debris") is removed according to a predetermined unjamming procedure. A part of the cut roll sheet on the upstream side in the sheet conveyance direction in sheet conveyance unit ADU (hereinafter referred to as "sheet-feeding side end portion") is held by sheet feeding roller section 143, and a part of the cut roll sheet on the downstream side in sheet conveyance unit ADU (hereinafter referred to as "sheet-ejection side end portion") is held by sheet ejection roller section 151 (see FIG. 5B).

Specifically, in image forming apparatus 1, the conveyance section (main conveyance section 161, sheet feeding section 14, and sheet ejection section 15) includes the conveyance roller sections (entry roller section 165, sheet feeding roller section 143, and sheet ejection roller section 151 and the like) that convey a sheet in a sandwiching manner, and at least one of the conveyance roller sections (143 and 151) holds the sheet-feeding side end portion and the sheet-ejection side end portion of the cut long sheet when an image is formed on a long sheet (roll sheet).

Thus, when a long sheet is cut, the sheet-feeding side end portion and the sheet-ejection side end portion of the long sheet can be prevented from being dropped, and adhesion of dust can be prevented from being caused, and thus, the interior parts of the apparatus does not contaminated or damaged by the adhered dust in the subsequent sheet conveyance tasks. In addition, since the state that allows conveyance of a roll sheet is maintained, the subsequent sheet conveyance tasks are facilitated.

At step S103, control section 17 controls operation display section 12 to display an unjamming procedure. In accordance with the unjamming procedure thus displayed, the user performs predetermined unjamming.

For example, the user turns a sheet-feeding side unjamming nob (not illustrated) to push, into sheet conveyance unit ADU, an end of roll sheet debris protruding to sheet feeding section 14 from sheet conveyance unit ADU. The sheet-feeding side unjamming nob (not illustrated) is connected with at least one of the conveyance roller sections of main conveyance section 161 through a power transmission mechanism. The sheet-feeding side unjamming nob is an operation nob configured to manually advance a roll sheet in the conveyance direction.

In addition, the user turns a sheet-ejection side unjamming nob (not illustrated) to push, into sheet conveyance unit ADU, another end of the roll sheet debris protruding to sheet feeding section 15 from sheet conveyance unit ADU. The sheet-ejection side unjamming nob (not illustrated) is connected with at least one of the conveyance roller sections of main conveyance section 161 through a power transmission mechanism. The sheet-ejection side unjamming nob is an operation nob configured to manually advance a roll sheet in a direction opposite to the conveyance direction.

By manually advancing an end and another end of the roll sheet debris in the sheet conveyance direction and the direction opposite to the sheet conveyance direction, respectively, to completely push the roll sheet debris into sheet conveyance unit ADU, it is possible to prevent the roll sheet debris from interfering the pulling out of sheet conveyance unit ADU. In the case where sheet-feeding side cutting section 31 and sheet-ejection side cutting section 32 are disposed in sheet conveyance unit ADU, the sheet-feeding side unjamming nob and the sheet-ejection side unjamming nob are turned to pull out the sheet-feeding side end portion and the sheet-ejection side end portion which exist in sheet conveyance unit ADU.

Figure 5C:
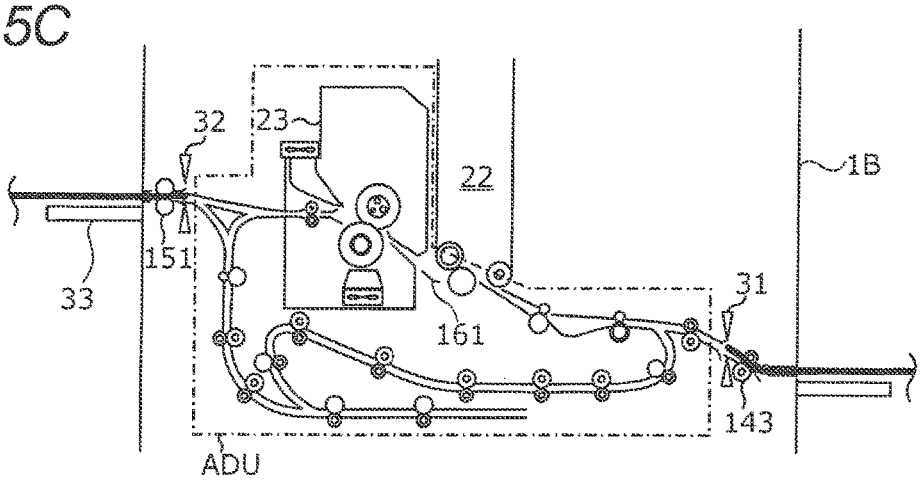

Thereafter, sheet conveyance unit ADU is pulled out to remove the roll sheet debris existing in sheet conveyance unit ADU (see FIG. 5C). Since the roll sheet is cut by sheet-feeding side cutting section 31 and sheet-ejection side cutting section 32, sheet conveyance unit ADU can be pulled out without causing breaking. In addition, since the roll sheet debris can be carefully removed from a suitable position by exposing a guide member and the like of sheet conveyance unit ADU, the possibility that unfixed toner formed on roll sheet debris scatters is small. In addition, since the roll sheet debris remaining in the apparatus can be surely removed, the components can be prevented from being damaged by the remaining paper debris.

At step S104, control section 17 determines whether the jam has been eliminated. For example, when conveyance of a roll sheet is requested by an operation on operation display section 12, control section 17 determines that the jam has been eliminated. In addition, for example, when it is detected that sheet conveyance unit ADU is reset to the original state and that the front door is closed, control section 17 determines that the jam has been eliminated.

It should be noted that when abnormal torque is generated at the time when conveyance roller section is operated, it can be said that the jam has not been eliminated, the process of step S104 is repeated.

Figure 6A:
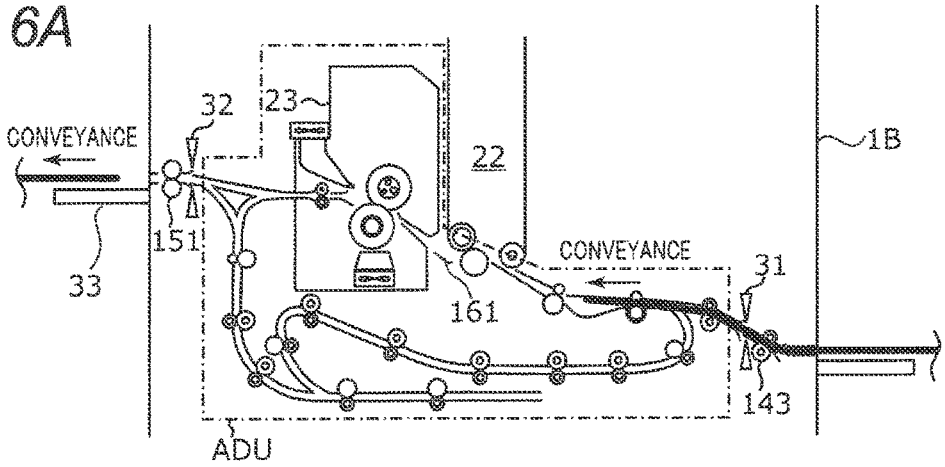
FIG. 6A and FIG. 6B illustrate detailed steps in the jam eliminating process.
Figure 6B:
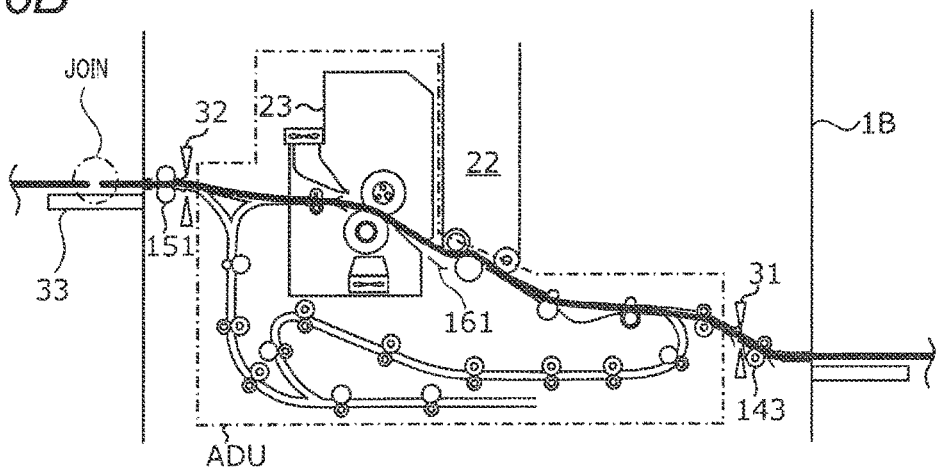

At step S105, control section 17 operates the conveyance roller section (including sheet feeding roller section 143 and sheet ejection roller section 151) to convey the roll sheet in the sheet conveyance direction (see FIG. 6A). At the time when the sheet-feeding side end portion and the sheet-ejection side end portion of the roll sheet are ejected out of the apparatus on the sheet ejection side, the operation of the conveyance roller section is stopped (see FIG. 6B). The end portion of the roll sheet output from the apparatus is placed on work stand 33, and joined with a tape or the like by the user.

It is to be noted that, at step S105, the sheet-feeding side end portion and the sheet-ejection side end portion of the roll sheet may be conveyed in the direction opposite to the sheet conveyance direction so as to join the both end portions at the outside of the apparatus on the sheet feeding side. It should be noted that in this case, the joint part passes through the secondary transfer section and the fixing section, and therefore the joint part may damage the components in the apparatus.

Specifically, in image forming apparatus 1, the conveyance section (main conveyance section 161, sheet feeding section 14 and sheet ejection section 15) conveys a long sheet (roll sheet) until the sheet-feeding side end portion and the sheet-ejection side end portion of the long sheet (roll sheet) are ejected out of the apparatus on the sheet feeding side or the sheet ejection side of the apparatus. Preferably, the conveyance section (161, 14 and 15) conveys a long sheet (roll sheet) in the sheet conveyance direction of image formation.

Since the sheet-feeding side end portion and the sheet-ejection side end portion of a roll sheet is conveyed to the outside of the apparatus by the operation of the conveyance section (161, 14 and 15), it is not necessary to again convey a roll sheet from the outside of the apparatus, and as a result the task of conveying the roll sheet and the task of joining the end portions of the roll sheet can be performed in a short time.

At step S106, control section 17 restarts the conveyance of the roll sheet. The image formation on the roll sheet is restarted, and the jam eliminating process is again executed at step S101.

While the invention made by the present inventor has been specifically described based on the preferred embodiments, it is not intended to limit the present invention to the above-mentioned preferred embodiments but the present invention may be further modified within the scope and spirit of the invention defined by the appended claims.

For example, in the case where a jam is caused when image formation is performed on flat sheets for a banner or a hanging banner, or standard flat sheets, the sheet may not exist across the sheet-feeding side boundary and the sheet-ejection side boundary during the conveyance. Therefore, the cutting section to be operated may be determined on the basis of the conveyance state of the sheet by determining the conveyance state of the sheet when a jam is caused (or by determining whether the sheet exists across the sheet sheet-feeding side boundary and the sheet-ejection side boundary). The conveyance state of the sheet at the time when a jam is caused can be determined on the basis of results of detection with use of a sheet detection sensor which is provided in commonly used image forming apparatuses, for example.

Further, for example, in addition to sheet-feeding side cutting section 31 and sheet-ejection side cutting section 32, a cutting section may be disposed on the sheet feeding path. The cutting section may be disposed in sheet conveyance unit ADU.

The embodiment disclosed herein is merely an exemplification and should not be considered as limitative. The scope of the present invention is specified by the following claims, not by the above-mentioned description. It should be understood that various modifications, combinations, sub-combinations and alterations may occur depending on design requirements and other factors in so far as they are within the scope of the appended claims or the equivalents thereof.

What is claimed is:

1. An image forming apparatus comprising:

a main body including:

a conveyance section configured to convey a roll sheet along a sheet feeding path, an image forming section configured to transfer and fix a toner image on the roll sheet conveyed by the conveyance section to form an image, a cabinet that includes the conveyance section and the image forming section, a jam detection section configured to detect occurrence of a jam in the sheet feeding path, and a plurality of cutting sections configured to cut the roll sheet that is conveyed through the sheet feeding path in a sheet width direction when occurrence of a jam is detected by the jam detection section;

a sheet feeding apparatus that feeds the roll sheet to an upstream side of the main body; and a winding apparatus arranged at a downstream side of the main body that winds up the roll sheet on which the image has been formed by the main body, wherein the conveyance section includes a sheet conveyance unit that is detachably mounted in the main body so that the sheet conveyance unit can be removed in its entirety as a single unit, in a conveyance direction of the roll sheet, and upstream-side end portion of the sheet conveyance unit is adjacent to an upstream-side surface of the cabinet, and a downstream-side end portion of the sheet conveyance unit is adjacent to a downstream-side side surface of the cabinet, the plurality of cutting sections include a first cutting section disposed proximate the upstream-side end portion of the sheet conveyance unit and a second cutting section disposed proximate the downstream-side end portion of the sheet conveyance unit.

2. The image forming apparatus according to claim 1, wherein the plurality of cutting sections are disposed near a boundary between the sheet conveyance unit and the main body part.

3. The image forming apparatus according to claim 2, wherein the conveyance section includes a plurality of conveyance roller sections configured to convey a sheet in a sandwiching manner, wherein the conveyance roller sections include:

a sheet feeding roller disposed at the most upstream side in the sheet conveyance direction in the apparatus; and a sheet ejection roller disposed at the most downstream side in the sheet conveyance direction in the apparatus, and the plurality of cutting sections are disposed between the sheet feeding roller and the sheet ejection roller.

4. The image forming apparatus according to claim 3, wherein the sheet feeding roller and the sheet ejection roller hold the sheet-feeding side end portion and the sheet-ejection side end portion of a cut sheet respectively.

5. The image forming apparatus according to claim 1, wherein the conveyance section includes a plurality of conveyance roller sections configured to convey a sheet in a sandwiching manner, and, at least one of the plurality of conveyance roller sections holds a sheet-feeding side end portion and a sheet-ejection side end portion of a cut sheet.

6. The image forming apparatus according to claim 5, wherein the conveyance section conveys a sheet until the sheet-feeding side end portion and the sheet-ejection side end portion are ejected out of the apparatus on a sheet feeding side or a sheet ejection side of the apparatus.

7. The image forming apparatus according to claim 6, wherein the conveyance section conveys a sheet in a sheet conveyance direction of image formation.

8. The image forming apparatus according to claim 5 further comprising a work stand on which to place the sheet-feeding side end portion and the sheet-ejection side end portion to join the end portions on an outside of the apparatus.

9. The image forming apparatus according to claim 1, further comprising a fixing section configured to fix the toner image on the sheet conveyed by the conveyance section, wherein the fixing section and the conveyance section are incorporated together in the sheet conveyance unit that is detachably mounted as a unit in the main body part of the image forming apparatus.

10. The image forming apparatus according to claim 1, wherein the sheet conveyance unit can be pulled out of the main body.

11. The image forming apparatus according to claim 1, wherein the upstream side of the main body and the downstream side of the main body are opposing sides of the main body.

12. An image forming apparatus comprising:

a main body including:

a conveyance section configured to convey a roll sheet along a sheet feeding path, an image forming section configured to transfer and fix a toner image on the roll sheet conveyed by the conveyance section to form an image, a cabinet that includes the conveyance section and the image forming section, a jam detection section configured to detect occurrence of a jam in the sheet feeding path, and a plurality of cutting sections, each being a cutting area for cutting the roll sheet that is conveyed through the sheet feeding path in a sheet width direction when occurrence of a jam is detected by the jam detection section;

a sheet feeding apparatus that feeds the roll sheet to an upstream side of the main body; and a winding apparatus arranged at a downstream side of the main body that winds up the roll sheet on which the image has been formed by the main body, wherein the conveyance section includes a sheet conveyance unit that is detachably mounted in the main body so that the sheet conveyance unit can be removed in its entirety as a single unit, in a conveyance direction of the roll sheet, and upstream-side end portion of the sheet conveyance unit is adjacent to an upstream-side surface of the cabinet, and a downstream-side end portion of the sheet conveyance unit is adjacent to a downstream-side side surface of the cabinet, the plurality of cutting sections include a first cutting area disposed between the upstream-side end portion of the sheet conveyance unit and the upstream-side side surface of the cabinet, and a second cutting area disposed between the downstream-side end portion of the sheet conveyance unit and the downstream-side surface of the cabinet.

* * * * *